US005583307A

United States Patent [19]

Tobia, Jr.

[11] Patent Number: 5,583,307

[45] Date of Patent: Dec. 10, 1996

[54] DRUM HEAD FOR TRIGGERING ELECTRONIC DRUMS

[76] Inventor: Thomas Tobia, Jr., 6022 Holt Rd. #4, Williamsburg, Mich. 49690

[21] Appl. No.: 428,537

[22] Filed: Apr. 25, 1995

[51] Int. Cl.[6] ..... G10D 13/02

[52] U.S. Cl. ..... 84/411 R; 84/414; 84/DIG. 12

[58] Field of Search ..... 84/411 R, 414, 84/723, 725, 730, 743, DIG. 12, DIG. 24

[56] References Cited

U.S. PATENT DOCUMENTS

| | | | |
|---|---|---|---|
| 3,509,264 | 4/1970 | Green | 84/411 P |
| 4,242,937 | 1/1981 | Pozar | 84/411 P |
| 4,581,972 | 4/1986 | Hoshino | 84/411 PX |
| 4,581,973 | 4/1986 | Hoshino | 84/411 |
| 4,984,498 | 1/1991 | Fishman | 84/730 |
| 5,042,356 | 8/1991 | Karch | 84/725 |
| 5,056,403 | 10/1991 | Yamashita | 84/723 |

*Primary Examiner*—Patrick J. Stanzione

[57] ABSTRACT

A drum head (27) that is used for triggering electronic drums and that fits on a drum the same as an acoustic drum head fits and held on with a drum rim (33). A rubber pad (23) is adhered to a drum head (27) with a circular vibration board (12) adhered underneath leaving the drum head (27) in between. A transducer (14) adhered to the circular vibration board (12) senses the vibration when the pad is struck and transmits an electronic signal to a sound source by way of a cord (29). The cord (29) is plugged into a ¼" jack (16) mounted on to an angled recessed ¼" jack plate (25) which keeps the cord low and away from the playing surface.

1 Claim, 1 Drawing Sheet

DRUM HEAD FOR TRIGGERING ELECTRONIC DRUMS

BACKGROUND OF THE INVENTION

1. Field of Invention

This invention relates to musical instruments, specifically to a triggering device for electronic drums.

2. Description of Prior Art

Electronic drums have increased in popularity over the years and with new technology that popularity will most likely continue. With this new technology has come many types of triggering devices used to trigger the abundance of percussion sounds on the market today. Triggering devices can be a pad. U.S. Pat. No. 5,056,403 to Yamashita (1991) is a slim pad with a plastic molded body, a transducer mounted inside on a vibration board of some type and a rubber pad that is struck with a drum stick. There is also a clamping device for mounting the unit on a stand. However, the disadvantages to this pad and other similar pads on the market are: 1) They are very expensive. 2) The clamping device requires a specific type of hardware stand. These stands are not universal which requires you to buy different stands for different pads. This is expensive and adds to the amount of equipment that must be moved. 3) Adding these pads to your conventional drum set can make things cluttered. This can be a problem when space on stage is often limited. U.S. Pat. No. 5,042,356 to Karch (1991) discloses a kit in which a conventional drum can be transformed into an electronic drum. This eliminates the need for additional hardware. However, the disadvantages are that this kit requires substantial modification of your acoustic drums. For example, drilling holes, mounting brackets with additional screws and/or gluing. These modifications can permanently alter the sound of your acoustic drum which can be a problem when you decide to remove the kit and use your acoustic drums in their original state. The other disadvantage is that the application and removal is very time consuming. U.S. Pat. No. 4,581,973 to Hoshino (1986) shows a pad that uses a drum head as its playing surface to trigger electronic drums. Although the drum head gives a more natural feel, it is contained within a pad. This pad, like most pads, require a mounting bracket or separate stand to use. Furthermore, because of it's odd shape, this pad is not compatible or interchangeable with an acoustic drum. U.S. Pat. No. 4,984, 498 to Fishman (1989) is a transducer. This can be used as a trigger by itself. They are relatively inexpensive and conveniently small. However, the disadvantages are that they require tape for mounting. Tape can dry up, wear out and the triggers will fall off. Also, when mounted on the top drum head they can be hit with a stick accidentally and break. Another disadvantage is when playing in a smaller venue the acoustic drum sound can be louder than the electric drums. To compensate for this the drums must be muffled to various degrees. This can be costly, time consuming and will alter the acoustic sound dramatically.

U.S. Pat. No. 4,581,972 to Hoshino (1986), shows a pad comprising a cushion and plate combination to trigger electronic drum sounds. The disadvantage to this is that this pad is structured with a molded shell around it and can only be used that way. It is not a drum head and is not interchangeable with a conventional drum head from a conventional drum. This could be costly and take up space.

OBJECTS AND ADVANTAGES

Accordingly, the objects and advantages of my invention are: 1) To provide a triggering device that is self contained and requires no other hardware or equipment to use. Additional hardware can be costly. 2) To provide a triggering device that does not require any drilling, gluing, taping, screwing or other modifications that may otherwise damage the drum and its sound. 3) To provide a triggering device that is put on, held in place, and taken off the same as an acoustic drum head. 4) To provide an easy way to combine electric drums and acoustic drums without taking up extra room by cluttering up existing set-ups. 5) To provide a drum head for triggering electronic drums that could be made in various sizes to accommodate the acoustic drum being used. 6) To provide a head that triggers electronic drums where the electronic plug can be plugged into the drum head directly. From the drawings and ensuing description, further objects and advantages will become apparent.

REFERENCE NUMBERS

12—Circular Vibration Board

14—Transducer

16—¼" Jack

21—Drum Head Rim

23—Rubber Pad

25—Angled Recessed ¼" Jack Plate

27—Drum Head

29—¼" Cord

31—Drum

33—Drum Rim

35—Jack Plate Mounting Screws

Figure 1:
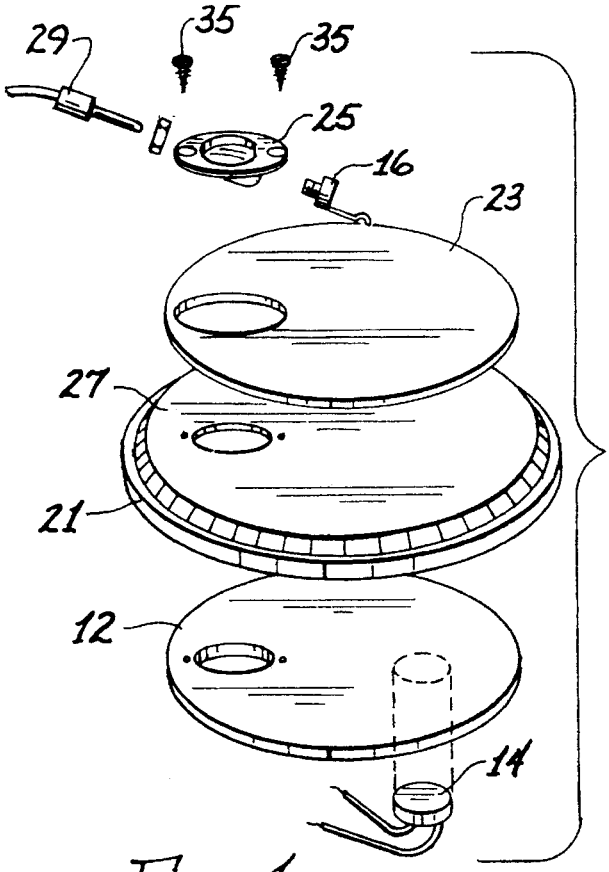
FIG. 1 shows an exploded view of the component parts used in my invention.
Figure 2:
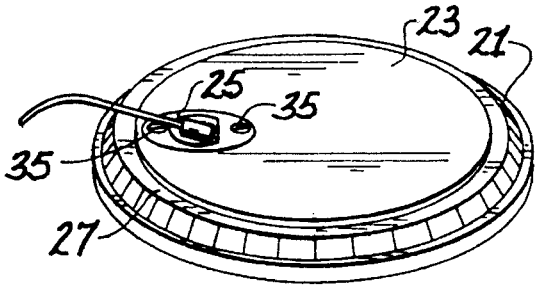
FIG. 2 shows a top view of my invention.
Figure 3:
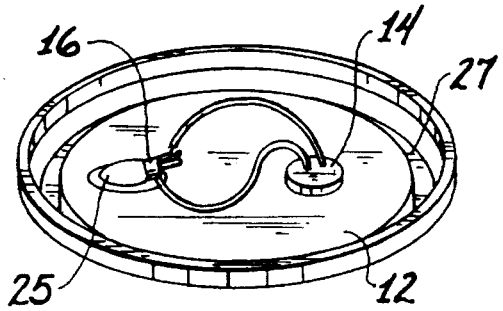
FIG. 3 shows a bottom view of my invention.

With further reference to FIGS. FIG. 1 shows the components that make up the present invention. A rubber pad 23 made of gum rubber, synthetic rubber, or the like, ⅛" in thickness, adhered to the top of a drum head 27 of a plastic film or the like and drum head rim 21 of metal or the like. Rubber pad 23 is cut 1" less in diameter than a drum head 27. This would leave approximately ½" border around drum head 27. Best shown in FIG. 2. Under drum head 27 a circular Vibration Board 12 is cut to the same diameter as rubber pad 23. Circular Board 12 is made of wood or the like approximately ⅜" thick and adhered to the under side of Drum Head 27 lined up directly under rubber pad 23 leaving Drum Head 27 in between. Best shown in FIG. 4. A hole is cut through rubber pad 23, Drum Head 27 and Circular Vibration Board 12 to accommodate an angled recessed ¼" Jack Plate 25. Angled recessed ¼" Jack Plate 25 can be metal or the like and is kept in place with Jack Plate Mounting Screws 35 or the like. On the underside of Circular Vibration Board 12 a transducer 14 is adhered into place. The wires of transducer 14 are connected to a ¼" Jack 16 which is mounted on Angled Recessed ¼" Jack Plate 25. Best shown in FIGS. 3 and 4. FIG. 2 shows the top view of my invention with Rubber Pad 23 adhered to Drum Head 27 with an Angled Recessed ¼" Jack Plate 25 mounted on top. FIG. 3 shows the bottom view of my invention showing Circular Vibration Board 12 adhered to bottom of Drum Head 27. This view also shows Transducer 14 adhered to bottom of Circular Vibration Board 12. Said Transducer is shown connected to ¼" Jack 16.

Figure 4:
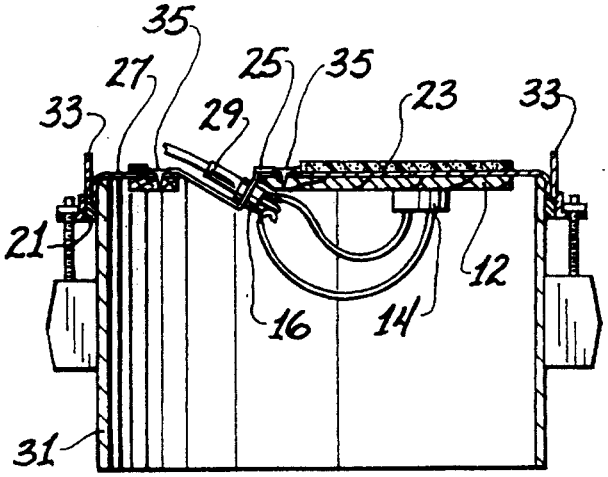
FIG. 4 shows a cross section of my invention in its application on an acoustic drum.

FIG. 4 shows the cross section view of my invention mounted on a Drum 31 and secured by a Drum Rim 33. A ¼" Cord 29 best shows the uniqueness of the Angled Recessed ¼" Jack Plate 25.

DESCRIPTION OF PREFERRED EMBODIMENT

The manner of using this device is by taking off your acoustic drum head and replacing it with the triggering head. Then plug cord from sound source directly into the triggering head. The triggering head is played on the same as an acoustic head. This head is struck on top rubber pad 23 which vibrates the circular vibration board 12 sending signal to transducer 14 which sends signal to your sound source by way of cord plugged into the angle recessed ¼" jack plate 25 and ¼" jack 16. Head 27 serves three purposes: 1) supports all components, 2) gives invention a natural feel when struck, 3) enables invention to be mounted on acoustic drum the same as acoustic head.

CONCLUSION, RAMIFICATION AND SCOPE

Thus the reader will see that the invention provides a more efficient, more simple and inexpensive triggering device that can be used on a conventional drum without any modifications to the drum or additional hardware. While my above description contains many specificities, these should not be mistaken as limitations on the scope of the invention, but rather as an illustration of one preferred embodiment thereof. Another variation is possible. For example, a hole could be cut in the acoustic drum head leaving a 1" border all around. A rubber pad could be adhered over the head supported by the 1" border. The vibration board is adhered underneath and suspended by the rubber pad. The Transducer adhered to the board would be connected to ¼" jack. Another variation would be to use a straight flushmount ¼" jack plate instead of the angled recessed plate. Other variations would be in color and size. Accordingly, the scope of the invention should be determined not by the illustrations but by the attached claims and their legal equivalents.

I claim:

1. A drumhead for mounting on an acoustic drum and for triggering electronic sound means comprising: an acoustic drumhead means, an angular jack plug means mounted on top of said drumhead and going downward thorugh the drumhead means and connecting to a pick-up means on the underside of said drumhead.

* * * * *